US012686991B2

(12) United States Patent
Oi et al.

(10) Patent No.: US 12,686,991 B2
(45) Date of Patent: Jul. 21, 2026

(54) CONTROL DEVICE, LOADING MACHINE, AND CONTROL METHOD TO DETERMINE A TARGET AZIMUTH DIRECTION

(71) Applicant: KOMATSU LTD., Tokyo (JP)

(72) Inventors: Takeshi Oi, Tokyo (JP); Kazuhiro Hatake, Tokyo (JP)

(73) Assignee: KOMATSU LTD., Tokyo (JP)

( * ) Notice: Subject to any disclaimer, the term of this patent is extended or adjusted under 35 U.S.C. 154(b) by 116 days.

(21) Appl. No.: 18/907,805

(22) Filed: Oct. 7, 2024

(65) Prior Publication Data

US 2025/0027290 A1 Jan. 23, 2025

Related U.S. Application Data

(62) Division of application No. 16/973,635, filed as application No. PCT/JP2019/028342 on Jul. 18, 2019, now Pat. No. 12,139,880.

(30) Foreign Application Priority Data

Aug. 31, 2018 (JP) ..... 2018-163416

(51) Int. Cl.
*E02F 3/43* (2006.01)
*E02F 9/26* (2006.01)

(52) U.S. Cl.
CPC ..... *E02F 3/431* (2013.01); *E02F 9/26* (2013.01)

(58) Field of Classification Search
CPC ..... E02F 9/26; E02F 3/431
See application file for complete search history.

(56) References Cited

U.S. PATENT DOCUMENTS 6,363,632 B1 4/2002 Stentz et al.
2002/0063652 A1 * 5/2002 Price ..... E02F 9/245 342/22

(Continued)

FOREIGN PATENT DOCUMENTS

AU 2017282197 B2 12/2017
CN 102947513 A 2/2013

(Continued)

OTHER PUBLICATIONS

The International Search Report for the corresponding international application No. PCT/JP2019/028342, issued on Oct. 1, 2019.

*Primary Examiner* — Jess Whittington
(74) *Attorney, Agent, or Firm* — Spencer Fane LLP

(57) ABSTRACT

A loading machine includes a swing body, work equipment provided on the swing body, a posture measuring device to measure a posture of the swing body, and a depth detecting sensor to detect a depth of at least part of a surrounding of the swing body in a detection range. A control device controls the loading machine. The control device includes a posture information acquisition unit that acquires posture information indicating the posture measured, a detection information acquisition unit that acquires depth information indicating the depth detected, a target azimuth direction determination unit, and an output unit. The target azimuth direction determination unit determines a target azimuth direction in swing control based on the posture information and the depth information acquired when the swing body is stopped swinging. The output unit outputs a swing operation signal based on the target azimuth direction.

5 Claims, 8 Drawing Sheets

(56) References Cited

U.S. PATENT DOCUMENTS

| | | | | |
|---|---|---|---|---|
| 2012/0263566 | A1* | 10/2012 | Taylor | E02F 3/54 701/50 |
| 2013/0103247 | A1 | 4/2013 | Ogawa et al. | |
| 2015/0225923 | A1 | 8/2015 | Wallace et al. | |
| 2016/0024757 | A1* | 1/2016 | Nomura | E02F 9/2054 701/32.3 |
| 2016/0298316 | A1 | 10/2016 | Iwamura et al. | |
| 2018/0094408 | A1* | 4/2018 | Shintani | E02F 9/26 |
| 2018/0305902 | A1* | 10/2018 | Tsukamoto | E02F 3/439 |
| 2020/0277757 | A1* | 9/2020 | Kurokami | E02F 9/24 |
| 2020/0277758 | A1* | 9/2020 | Edamura | E02F 9/2296 |
| 2020/0392701 | A1* | 12/2020 | Aizawa | E02F 9/262 |
| 2021/0002850 | A1* | 1/2021 | Wu | E02F 3/43 |
| 2021/0010237 | A1* | 1/2021 | Aizawa | E02F 3/439 |
| 2021/0025135 | A1* | 1/2021 | Sakuta | E02F 9/2253 |
| 2021/0372086 | A1* | 12/2021 | Aizawa | E02F 9/262 |
| 2022/0259834 | A1* | 8/2022 | Chiba | E02F 3/32 |

FOREIGN PATENT DOCUMENTS

| | | | |
|---|---|---|---|
| CN | 106906866 | A | 6/2017 |
| EP | 0 900 887 | A1 | 3/1999 |
| EP | 3 399 109 | A1 | 7/2018 |
| GB | 2 222 998 | A | 3/1990 |
| JP | 2-88824 | A | 3/1990 |
| JP | 2000-136549 | A | 5/2000 |
| JP | 2000-291076 | A | 10/2000 |
| JP | 2016-89389 | A | 5/2016 |
| JP | 2017-227014 | A | 12/2017 |
| JP | 2017-227104 | A | 12/2017 |
| WO | 2015/137527 | A1 | 9/2015 |
| WO | 2017/115809 | A1 | 7/2017 |

* cited by examiner

CONTROL DEVICE, LOADING MACHINE, AND CONTROL METHOD TO DETERMINE A TARGET AZIMUTH DIRECTION

CROSS-REFERENCE TO RELATED APPLICATIONS

This application is a divisional application of U.S. patent application Ser. No. 16/973,635 filed Dec. 9, 2020, which is a U.S. National stage application of International Application No. PCT/JP2019/028342, filed on Jul. 18, 2019, and claims priority under 35 U.S.C. § 119(a) to Japanese Patent Application No. 2018-163416, filed in Japan on Aug. 31, 2018. The entire contents of U.S. patent application Ser. No. 16/973,635, International Application No. PCT/JP2019/028342, and Japanese Patent Application No. 2018-163416 are hereby incorporated herein by reference.

BACKGROUND

Field of the Invention

The present invention relates to a control device, a loading machine, and a control method.

Background Information

Japanese Unexamined Patent Application, First Publication No. 2000-136549 discloses an autonomous control system for a loading machine that uses a sensor for measuring the depth of the environment provided in the loading machine. According to the technique disclosed in Japanese Unexamined Patent Application, First Publication No. 2000-136549, an obstacle is detected by scanning a region on a movement path by a sensor provided on a left side of a swing body while the swing body is swinging. Further, according to the technique disclosed in Japanese Unexamined Patent Application, First Publication No. 2000-136549, while the swing body is swinging, a sensor provided on a right side of the swing body scans a region of an excavated surface to specify the topography of the excavated surface, and data for planning the next excavation is generated.

SUMMARY

Incidentally, in order to specify the topography using depth data measured by the sensor, it is necessary to convert the data using the measurement data such as the position information and the swing angle of the loading machine. However, since the position and azimuth direction of the measuring device for obtaining the measurement data change while the swing body is swinging, the error included in the measurement data is large, and there is a possibility that the topography cannot be detected accurately. When the topography cannot be detected accurately, the target azimuth direction in swing control cannot be determined accurately.

An object of the present invention is to provide a control device, a loading machine, and a control method capable of accurately determining a target azimuth direction in swing control.

An aspect of the present invention provides a control device for controlling a loading machine including a swing body swingable around a swing center, work equipment provided on the swing body, a posture measuring device configured to measure a posture of the swing body, and a depth detecting sensor that is provided in the swing body and is configured to detect a depth of at least part of a surrounding of the swing body in a detection range. The posture measuring device includes receivers configured to receive positioning signals and an inertial measurement sensor configured to measure an acceleration and an angular speed of the swing body. The control device includes: a memory in which a program is loaded; and a processor configured to execute the program. The process includes, by executing the program: a posture information acquisition unit configured to acquire posture information indicating the posture measured by the posture measuring device; a detection information acquisition unit configured to acquire depth information indicating the depth detected by the depth detecting sensor; a target azimuth direction determination unit configured to determine a target azimuth direction in swing control based on the posture information and the depth information acquired when the swing body is stopped swinging; and an output unit configured to output a swing operation signal based on the target azimuth direction. The target azimuth direction determination unit is configured to determine an azimuth direction toward a loading target as the target azimuth direction based on the posture information and the depth information acquired while the work equipment performs excavation work on an excavation target.

Another aspect of the present invention provides a control method of a loading machine including a swing body swingable around a swing center by hydraulic oil supplied from a hydraulic pump included in a hydraulic device, work equipment provided on the swing body, a posture measuring device configured to measure a posture of the swing body, and a depth detecting sensor that is provided in the swing body and configured to detect a depth of a surrounding of the swing body in a detection range. The posture measuring device includes receivers configured to receive positioning signals and an inertial measurement sensor configured to measure an acceleration and an angular speed of the swing body. The control method includes: acquiring posture information indicating the posture measured by the posture measuring device; acquiring depth information indicating the depth detected by the depth detecting sensor; determining a target azimuth direction in swing control based on the posture information and the depth information acquired when the swing body is not swinging; and outputting, to the hydraulic device, a swing operation signal for swinging the swing body based on the target azimuth direction. The determining the target azimuth direction includes determining an azimuth direction toward a loading target as the target azimuth direction based on the posture information and the depth information acquired while the work equipment performs excavation work on an excavation target.

According to the above-described aspects, the control device can accurately determine the target azimuth direction in the swing control.

DETAILED DESCRIPTION OF EMBODIMENT(S)

Hereinafter, embodiments will be described with reference to the drawings.

First Embodiment (Configuration of Loading Machine)

Figure 1:
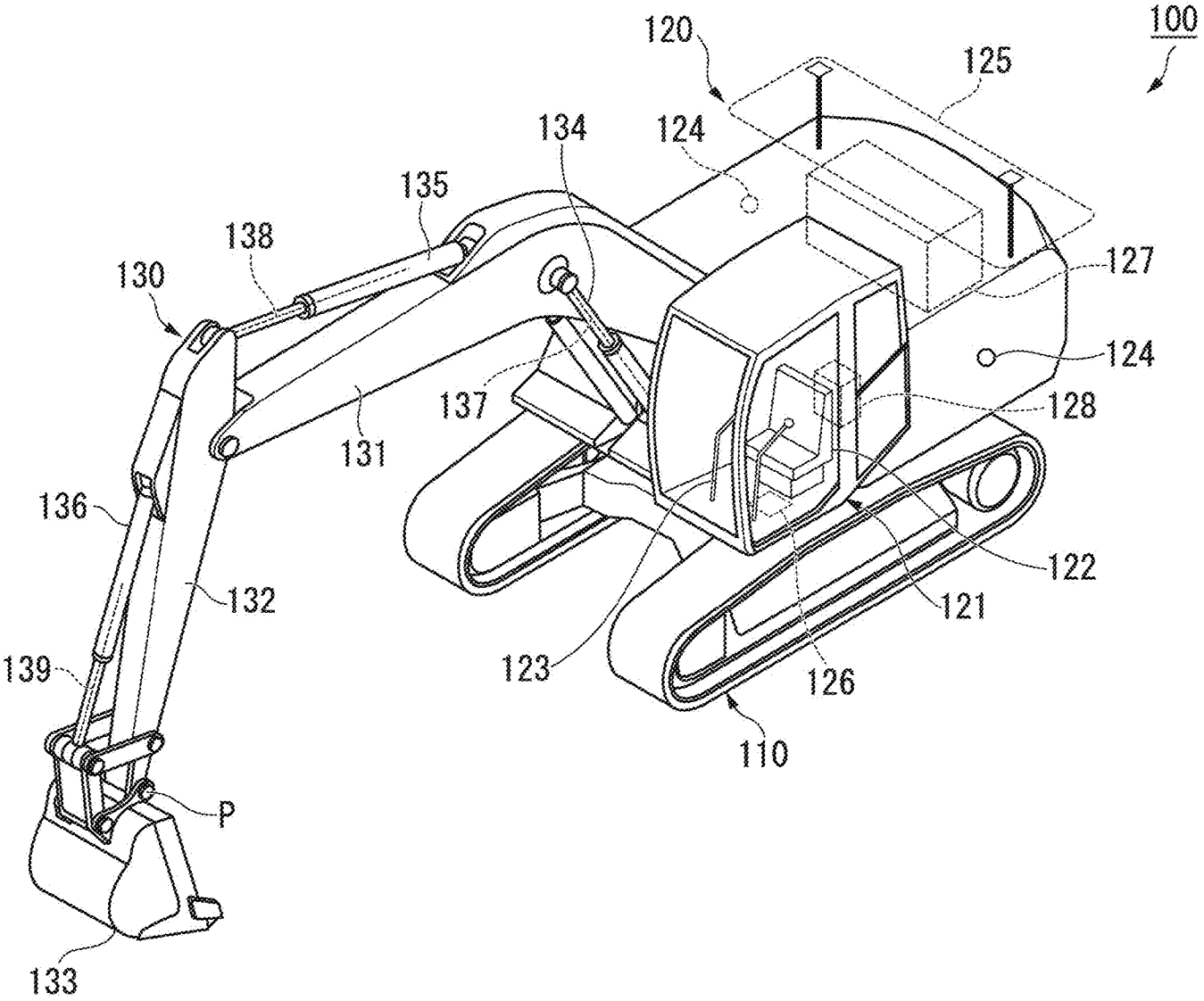
FIG. 1 is a schematic view showing a configuration of a loading machine according to a first embodiment.

FIG. 1 is a schematic view showing a configuration of a loading machine according to a first embodiment.

A loading machine 100 is a work machine for loading earth to a loading point, such as a transport vehicle. The loading machine 100 according to the first embodiment is a hydraulic excavator. The loading machine 100 according to another embodiment may be a loading machine other than the hydraulic excavator. In addition, although the loading machine 100 shown in FIG. 1 is a backhoe shovel, but may be a face shovel or a rope shovel.

The loading machine 100 includes a travel body 110, a swing body 120 supported by the travel body 110, and work equipment 130 operated by hydraulic pressure and supported by the swing body 120. The swing body 120 is supported so as to be swingable around a swing center.

The work equipment 130 includes a boom 131, an arm 132, a bucket 133, a boom cylinder 134, an arm cylinder 135, a bucket cylinder 136, a boom stroke sensor 137, an arm stroke sensor 138, and a bucket stroke sensor 139.

A base end portion of the boom 131 is attached to the swing body 120 via a pin.

The arm 132 connects the boom 131 and the bucket 133 to each other. A base end portion of the arm 132 is attached to a tip end portion of the boom 131 via a pin.

The bucket 133 includes an edge for excavating earth or the like, and a container for transporting the excavated earth. A base end portion of the bucket 133 is attached to the tip end portion of the arm 132 via a pin.

The boom cylinder 134 is a hydraulic cylinder for operating the boom 131. A base end portion of the boom cylinder 134 is attached to the swing body 120. A tip end portion of the boom cylinder 134 is attached to the boom 131.

The arm cylinder 135 is a hydraulic cylinder for driving the arm 132. A base end portion of the arm cylinder 135 is attached to the boom 131. A tip end portion of the arm cylinder 135 is attached to the arm 132.

The bucket cylinder 136 is a hydraulic cylinder for driving the bucket 133. A base end portion of the bucket cylinder 136 is attached to the arm 132. A tip end portion of the bucket cylinder 136 is attached to a link mechanism that rotates the bucket 133.

The boom stroke sensor 137 measures the stroke amount of the boom cylinder 134. The stroke amount of the boom cylinder 134 can be converted into the inclination angle of the boom 131 with respect to the swing body 120. Hereinafter, the inclination angle with respect to the swing body 120 is also referred to as an absolute angle. In other words, the stroke amount of the boom cylinder 134 can be converted into the absolute angle of the boom 131.

The arm stroke sensor 138 measures the stroke amount of the arm cylinder 135. The stroke amount of the arm cylinder 135 can be converted into the inclination angle of the arm 132 with respect to the boom 131. Hereinafter, the inclination angle of the arm 132 with respect to the boom 131 is also referred to as a relative angle of the arm 132.

The bucket stroke sensor 139 measures the stroke amount of the bucket cylinder 136. The stroke amount of the bucket cylinder 136 can be converted into the inclination angle of the bucket 133 with respect to the arm 132. Hereinafter, the inclination angle of the bucket 133 with respect to the arm 132 is also referred to as a relative angle of the bucket 133.

The loading machine 100 according to another embodiment may include an angle sensor that detects an inclination angle with respect to the horizontal plane or an inclination angle with respect to the swing body 120, instead of the boom stroke sensor 137, the arm stroke sensor 138, and the bucket stroke sensor 139.

The swing body 120 is provided with a cab 121. Inside the cab 121, a driver seat 122 for an operator to sit on, and an operating device 123 for operating the loading machine 100, are provided. The operating device 123 generates a raising operation signal and a lowering operation signal of the boom 131, a pushing operation signal and a pulling operation signal of the arm 132, a dump operation signal and an excavation operation signal of the bucket 133, and a swing operation signal to the left and right of the swing body 120, in accordance with the operation of the operator and outputs the generated signals to the control device 128. In addition, the operating device 123 generates an excavation and loading instruction signal for causing the work equipment 130 to start automatic excavation and loading control in accordance with the operation of the operator and outputs the generated excavation and loading instruction signal to the control device 128. The automatic excavation and loading control is control for automatically executing a series of operations of loading earth accommodated in the bucket 133 to the loading target 200 (for example, a transport vehicle or a hopper) by swinging the swing body 120, moving the work equipment 130 to the excavation point by swinging the swing body 120, and excavating earth at the excavation point.

The operating device 123 is configured with, for example, a lever, a switch, and a pedal. The excavation and loading instruction signal is generated by operating an automatic control switch. For example, when the switch is ON, the excavation and loading instruction signal is output. The operating device 123 is disposed in the vicinity of the driver seat 122. The operating device 123 is positioned within a range that can be operated by the operator when the operator sits on the driver seat 122.

In addition, the loading machine 100 according to the first embodiment is operated according to the operation of the operator who sits on the driver seat 122, but is not limited thereto in another embodiment. For example, the loading machine 100 according to another embodiment may be operated by transmitting the operation signal or the excavation and loading instruction signal by a remote operation of the operator who performs the operation outside the loading machine 100.

The loading machine 100 includes a depth detecting device 124 for detecting a three-dimensional position of an object that exists in the detection direction, a position and azimuth direction calculator 125, an inclination measuring instrument 126, a hydraulic device 127, and a control device 128.

Figure 2:
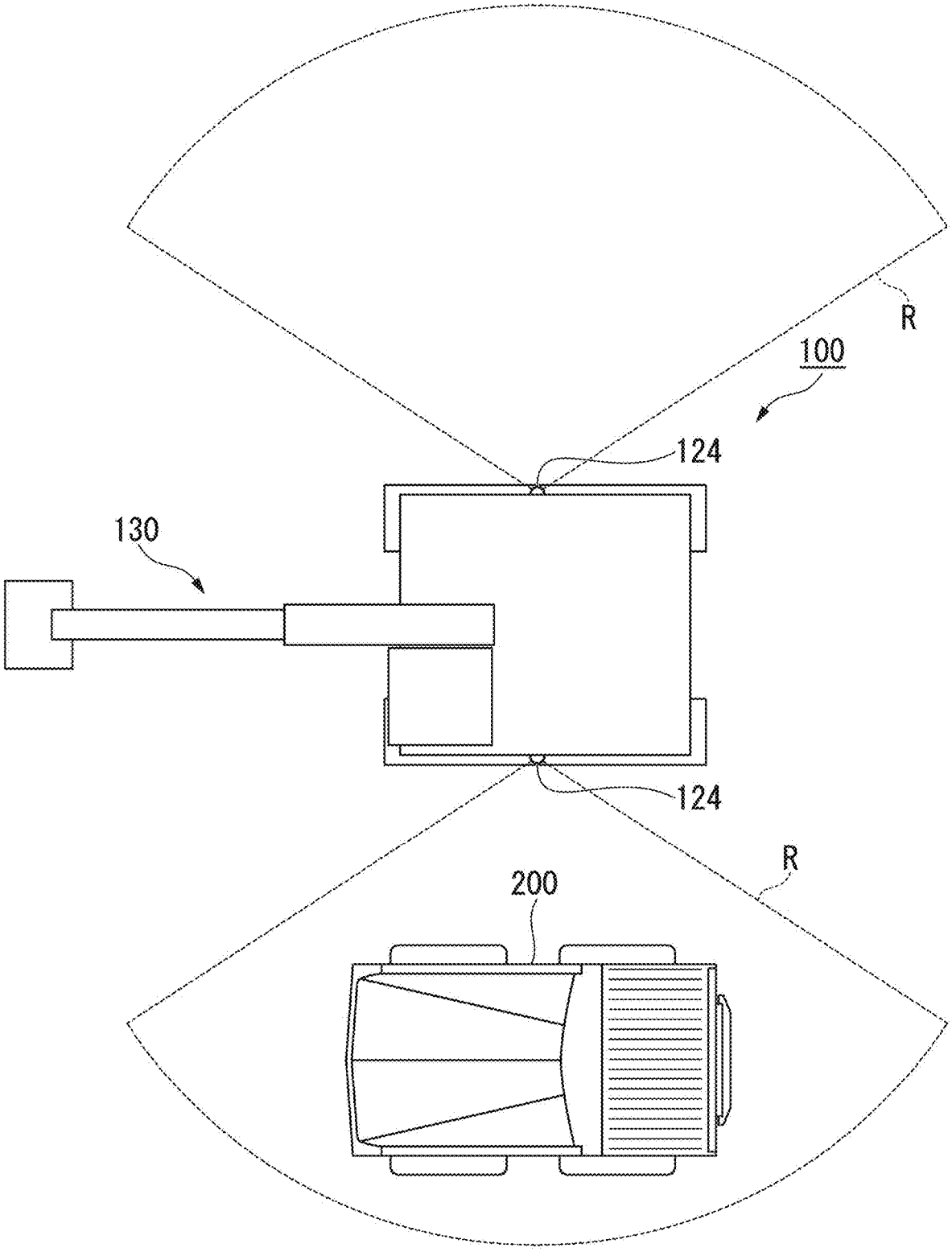
FIG. 2 is a top view showing an installation position of a depth detecting device in a work machine according to the first embodiment.

FIG. 2 is a top view showing an installation position of the depth detecting device in the work machine according to the first embodiment.

The depth detecting device 124 detects the depth in a detection range R. The depth detecting devices 124 are provided on both side surfaces of the swing body 120 and detects the depth of at least part of an object in the surrounding including the excavation target in the detection range R with an axis that extends in the width direction of the swing body 120 as a center. The depth is the distance from the depth detecting device 124 to the target. Accordingly, when the loading machine 100 is excavating earth by the work equipment 130, the depth detecting device 124 can detect the depth of the loading target 200 positioned on the side of the loading machine 100. The depth detecting device 124 can detect the depth of the excavation target when the loading machine 100 changes the azimuth direction in which the swing body 120 faces by the swing operation and loads earth to the loading target 200. In other words, since the orientation of the depth detecting device 124 changes due to the swing operation of the loading machine 100 in the excavation and loading work, the depth detecting device 124 can detect the place around the loading machine 100 over a wide range.

As shown in FIG. 2, the depth detecting device 124 is provided at a position where the work equipment 130 does not interfere with the detection range R. Examples of the depth detecting device 124 include, for example, a LiDAR device, a radar device, a stereo camera, and the like. The depth detecting device 124 is preferably provided at a high position of the swing body 120. The center axis of the detection range R of the depth detecting device 124 is preferably inclined downward in the horizontal direction.

The position and azimuth direction calculator 125 calculates a position of the swing body 120 and an azimuth direction in which the swing body 120 faces. The position and azimuth direction calculator 125 includes two receivers that receive positioning signals from artificial satellites that configure a GNSS. The two receivers are respectively installed at different positions on the swing body 120. Based on the positioning signal received by the receiver, the position and azimuth direction calculator 125 detects the position of the representative point (the origin of the excavator coordinate system) of the swing body 120 in a field coordinate system.

The position and azimuth direction calculator 125 calculates the azimuth direction in which the swing body 120 faces as a relationship between an installation position of one receiver and an installation position of the other receiver by using each positioning signal received by the two receivers. The azimuth direction in which the swing body 120 faces is the front direction of the swing body 120 and is equal to a horizontal component of the extending direction of a straight line that extends from the boom 131 of the work equipment 130 to the bucket 133. The azimuth direction of the swing body 120 is an example of posture information. The position and azimuth direction calculator 125 is an example of a posture measuring device.

The inclination measuring instrument 126 measures an acceleration and an angular speed of the swing body 120 and detects the posture (for example, roll angle and pitch angle) of the swing body 120 based on the measurement result. The inclination measuring instrument 126 is installed on a lower surface of the swing body 120, for example. For example, an inertial measurement unit (IMU) can be used as the inclination measuring instrument 126. The inclination measuring instrument 126 is an example of a posture measuring device.

The hydraulic device 127 includes a hydraulic oil tank, a hydraulic pump, and a flow control valve. The hydraulic pump is driven by the power of an engine (not shown) and supplies the hydraulic oil to a traveling hydraulic motor (not shown) that causes the travel body 110 to travel via the flow control valve, a swing hydraulic motor (not shown) that swings the swing body 120, the boom cylinder 134, the arm cylinder 135, and the bucket cylinder 136. The flow control valve has a rod-shaped spool, and adjusts the flow rate of the hydraulic oil supplied to the traveling hydraulic motor, the swing hydraulic motor, the boom cylinder 134, the arm cylinder 135, and the bucket cylinder 136, according to the position of the spool. The spool is driven based on a control command received from the control device 128. In other words, the amount of hydraulic oil supplied to the traveling hydraulic motor, the swing hydraulic motor, the boom cylinder 134, the arm cylinder 135, and the bucket cylinder 136 is controlled by the control device 128. As described above, the traveling hydraulic motor, the swing hydraulic motor, the boom cylinder 134, the arm cylinder 135, and the bucket cylinder 136, are driven by the hydraulic oil supplied from the common hydraulic device 127. In a case where the traveling hydraulic motor or the swing hydraulic motor is a swash plate type variable displacement motor, the control device 128 may adjust the rotation speed by the tilt angle of the swash plate.

The control device 128 receives the operation signal from the operating device 123. The control device 128 drives the work equipment 130, the swing body 120, or the travel body 110 based on the received operation signal.

(Configuration of Control Device)

Figure 3:
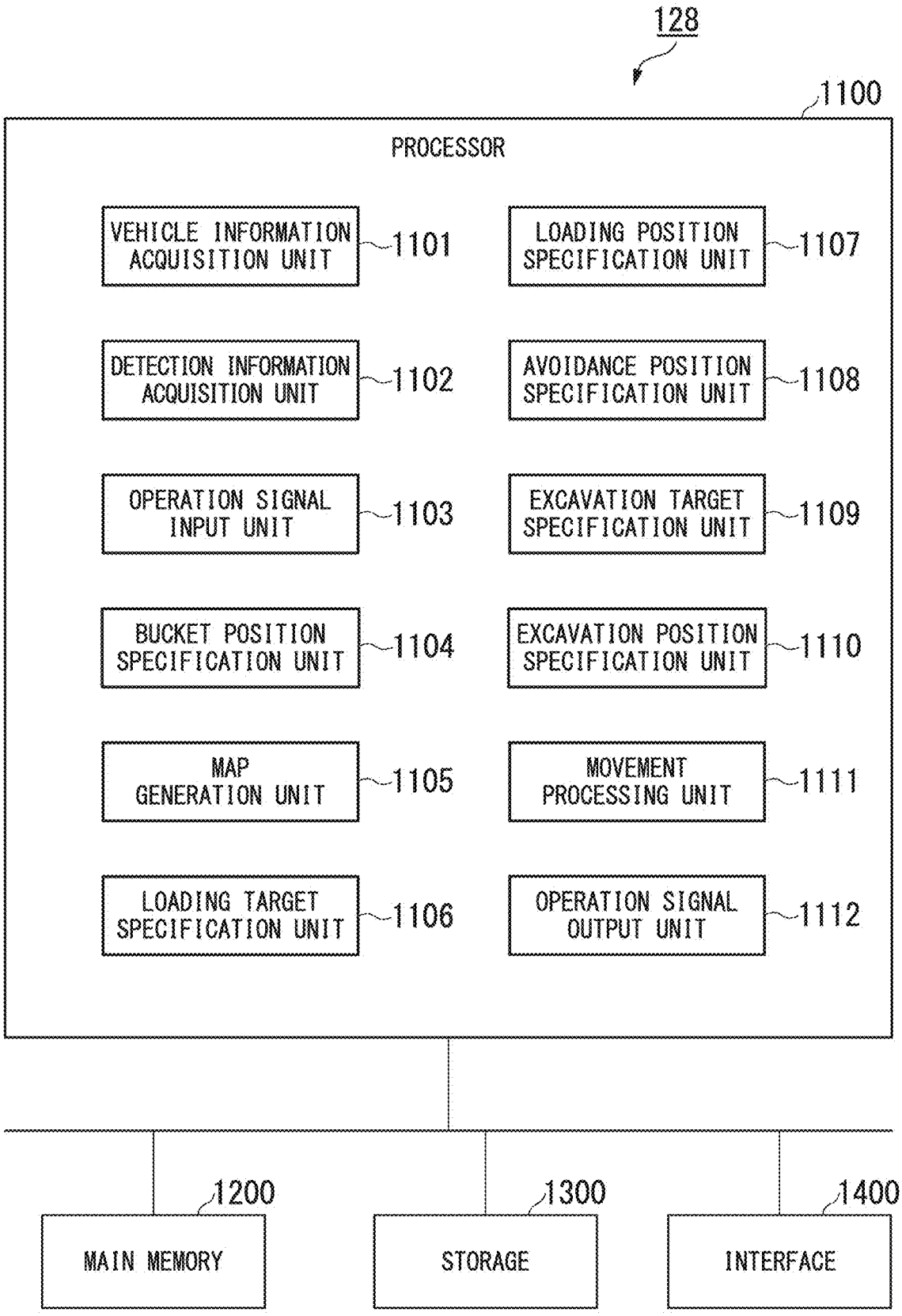
FIG. 3 is a schematic block diagram showing a configuration of a control device according to the first embodiment.

FIG. 3 is a schematic block diagram showing a configuration of the control device according to the first embodiment.

The control device 128 is a computer including a processor 1100, a main memory 1200, a storage 1300, and an interface 1400. The storage 1300 stores a program. The processor 1100 reads the program from the storage 1300, develops the program in the main memory 1200, and executes processing according to the program.

Examples of the storage 1300 include HDDs, SSDs, magnetic disks, magneto-optical disks, CD-ROMs, DVD-ROMs, and the like. The storage 1300 may be an internal medium directly connected to a common communication line of the control device 128, or may be an external medium connected to the control device 128 via the interface 1400. The storage 1300 is a tangible storage medium that is non-transitory.

The processor 1100 is executed by a program and includes a vehicle information acquisition unit 1101, a detection information acquisition unit 1102, an operation signal input unit 1103, a bucket position specification unit 1104, a map generation unit 1105, a loading target specification unit 1106, a loading position specification unit 1107, an avoidance position specification unit 1108, an excavation target specification unit 1109, an excavation position specification unit 1110, a movement processing unit 1111, and an operation signal output unit 1112.

The vehicle information acquisition unit 1101 acquires, for example, the swing speed, position, and azimuth direction of the swing body 120, the inclination angles of the boom 131, the arm 132, and the bucket 133, and the posture of the swing body 120. Hereinafter, information on the loading machine 100 acquired by the vehicle information acquisition unit 1101 will be referred to as vehicle information. The vehicle information acquisition unit is an example of the posture information acquisition unit.

The detection information acquisition unit 1102 acquires depth information from the depth detecting device 124. The depth information indicates the three-dimensional positions of a plurality of points within the detection range R. Examples of the depth information include a depth image consisting of a plurality of pixels representing the depth and point cloud data consisting of a plurality of points represented by a rectangular coordinate system (x, y, z).

The operation signal input unit 1103 receives an input of the operation signal from the operating device 123. The operation signal includes the raising operation signal and the lowering operation signal of the boom 131, the pushing operation signal and the pulling operation signal of the arm 132, the dump operation signal and the excavation operation signal of the bucket 133, the swing operation signal of the swing body 120, the traveling operation signal of the travel body 110, and the excavation and loading instruction signal of the loading machine 100.

Figure 4:
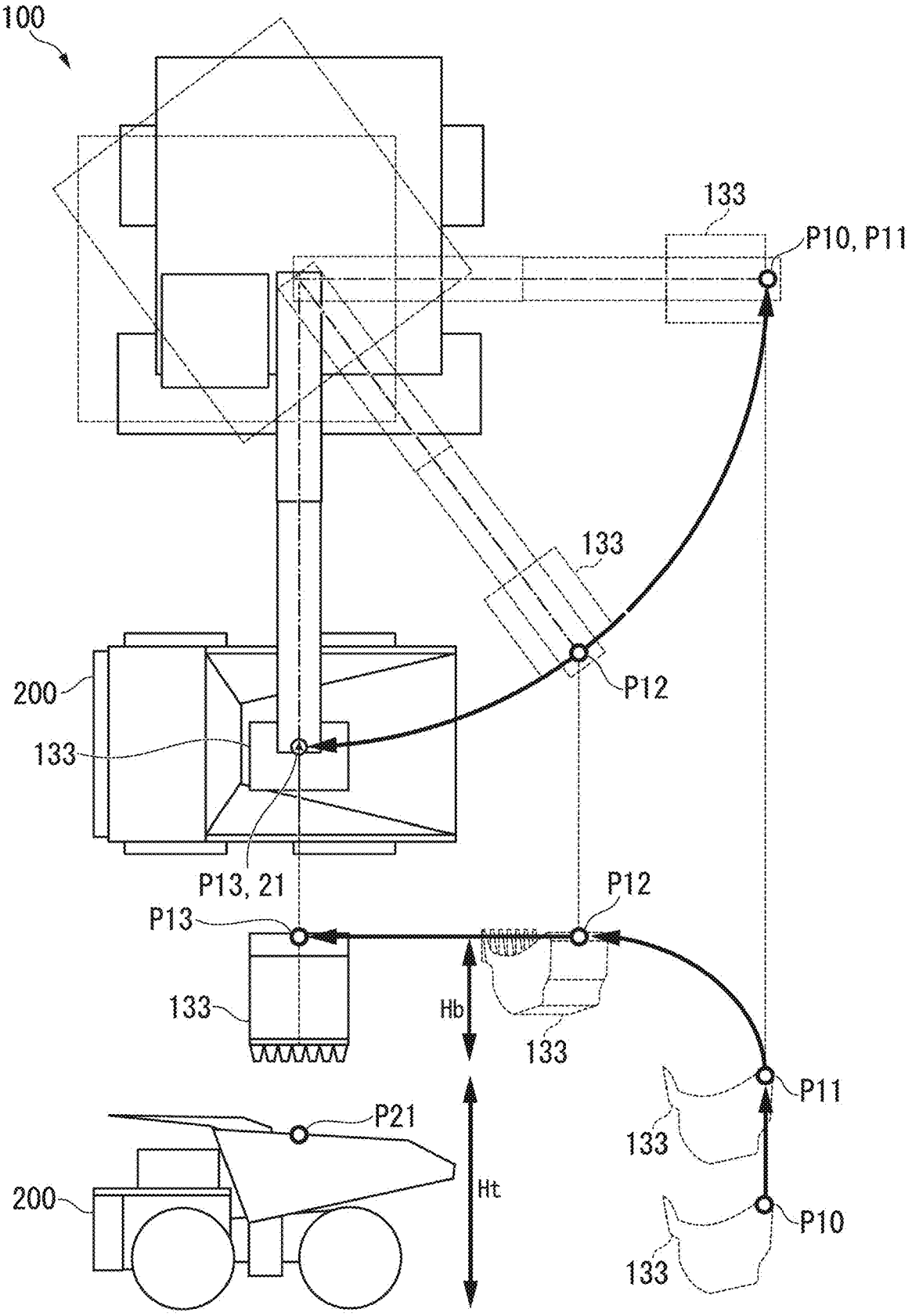
FIG. 4 is a view showing an example of a bucket path before dumping in automatic excavation and loading control according to the first embodiment.

FIG. 4 is a view showing an example of a bucket path before dumping in the automatic excavation and loading control according to the first embodiment.

Based on the vehicle information acquired by the vehicle information acquisition unit 1101, the bucket position specification unit 1104 specifies a position P of the tip end portion of the arm 132 in the excavator coordinate system and a height Hb from the tip end of the arm 132 to the lowest passing point of the bucket 133. The lowest passing point of the bucket 133 is a point where teeth are positioned when the distance between the teeth and the ground surface is the shortest during the dump operation of the bucket 133. In other words, the height Hb from the tip end of the arm 132 to the lowest passing point of the bucket 133 coincides with the length from the pin at the base end portion of the bucket 133 to the teeth.

In particular, the bucket position specification unit 1104 specifies the position P of the tip end portion of the arm 132 when the input of the excavation and loading instruction signal is received, as an excavation completion position P10. Since the base end portion of the bucket 133 is connected to the tip end portion of the arm 132, the position P of the tip end portion of the arm 132 is equal to the position of the base end portion of the bucket 133.

Specifically, the bucket position specification unit 1104 specifies the position P of the tip end portion of the arm 132 by the following procedure. The bucket position specification unit 1104 obtains the position of the tip end portion of the boom 131 based on the absolute angle of the boom 131, which is acquired from the stroke amount of the boom cylinder 134, and the known length (distance from the pin at the base end portion to the pin at the tip end portion) of the boom 131. The bucket position specification unit 1104 obtains the absolute angle of the arm 132 based on the absolute angle of the boom 131 and the relative angle of the arm 132, which is obtained from the stroke amount of the arm cylinder 135. The bucket position specification unit 1104 obtains the position P of the tip end portion of the arm 132 based on the position of the tip end portion of the boom 131, the absolute angle of the arm 132, and the known length (distance from the pin at the base end portion to the pin at the tip end portion) of the arm 132.

The map generation unit 1105 generates a three-dimensional map representing the shape of at least part of the surrounding of the loading machine 100 by the field coordinate system based on the position, azimuth direction, and posture of the swing body 120 acquired by the vehicle information acquisition unit 1101 when the swing body 120 is not swinging and the depth information acquired by the detection information acquisition unit 1102. Specifically, the time when the swing body 120 is not swinging is the time when the loading machine 100 is performing an excavating operation or a dump operation, and may not be a state where the swing speed is completely zero, and slight movement in the swing direction may be performed. In another embodiment, the map generation unit 1105 may generate a three-dimensional map related to the excavator coordinate system with the swing body 120 as a reference.

The loading target specification unit 1106 specifies the position and shape of the loading target 200 and the position of a loading point P21 based on the three-dimensional map generated by the map generation unit 1105. The loading point P21 is, for example, a point on the vessel of the dump truck. For example, the loading target specification unit 1106 specifies the position and shape of the loading target 200 and the loading point P21 by matching the three-dimensional shape shown by the three-dimensional map with the known shape of the loading target 200.

The loading position specification unit 1107 specifies a loading position P13 based on the loading point P21 specified by the loading target specification unit 1106 in a case where the excavation and loading instruction signal is input to the operation signal input unit 1103. Specifically, the loading position specification unit 1107 specifies the loading position P13 as follows.

The loading position specification unit 1107 specifies the specified loading point P21 as a plane position of the loading position P13. In other words, when the tip end of the arm 132 is positioned at the loading position P13, the tip end of the arm 132 is positioned above the loading point P21. Examples of the loading point P21 include the center point of the vessel in a case where the loading target 200 is a dump truck, and the center point of the opening in a case where the loading target 200 is a hopper. The loading position specification unit 1107 specifies a height of the loading position P13 by adding the height Hb from the tip end of the arm 132 specified by the bucket position specification unit 1104 to the lowest passing point of the bucket 133 and the height for the control margin of the bucket 133, to a height Ht of the loading target 200. In another embodiment, the loading position specification unit 1107 may specify the loading position P13 without adding the height for the control margin. In other words, the loading position specification unit 1107 may specify the height of the loading position P13 by adding the height Hb to the height Ht. The height Ht according to the first embodiment is the height from the ground to the upper surface of the vessel.

In other words, the loading position specification unit 1107 determines the target azimuth direction of the swing body 120 in the swing control by specifying the loading position P13. The loading position specification unit 1107 is an example of a target azimuth direction determination unit.

The avoidance position specification unit 1108 specifies an interference avoidance position P12 that is a point at which the work equipment 130 and the loading target 200 do not interfere with each other in a plan view from above based on the loading position P13 specified by the loading position specification unit 1107, the position of the loading machine 100 acquired by the vehicle information acquisition unit 1101, and the position and shape of the loading target 200 specified by the loading target specification unit 1106. The interference avoidance position P12 is a position at which the height thereof is the same height as that of the loading position P13, the distance from the swing center of the swing body 120 is equal to the distance from the swing center to the loading position P13, and the loading target 200 does not exist therebelow. The avoidance position specification unit 1108 specifies, for example, a circle of which the center is the swing center of the swing body 120 and of which the radius is the distance between the swing center and the loading position P13, and among the positions on the circle, specifies a position at which the outer shape of the bucket 133 does not interfere with the loading target 200 in a plan view from above and which is the closest to the loading position P13 as the interference avoidance position P12. The avoidance position specification unit 1108 can determine whether or not the loading target 200 and the bucket 133 interfere with each other based on the position and shape of the loading target 200 and the known shape of the bucket 133. Here, "the same height" and "the distances are equal" are not necessarily limited to cases where the heights or distances completely match each other and some errors and margins are allowed.

Figure 5:
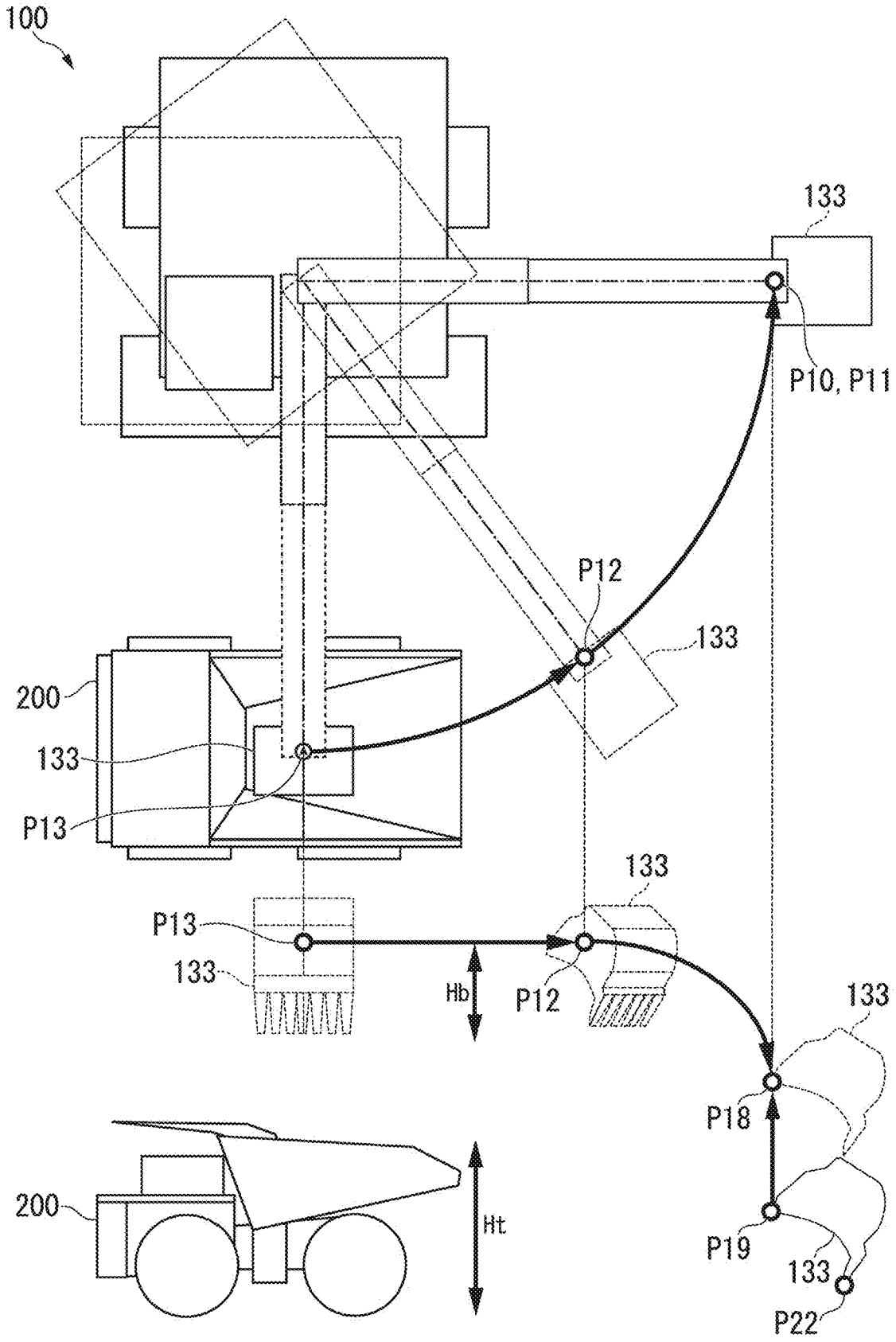
FIG. 5 is a view showing an example of a bucket path after dumping in the automatic excavation and loading control according to the first embodiment.

The excavation target specification unit 1109 specifies the position of the excavation point P22, which is the excavation target, based on the three-dimensional map generated by the map generation unit 1105. The excavation point P22 is a point where the arm 132 and the bucket 133 can excavate an amount of earth corresponding to the maximum capacity of the bucket 133, for example, by moving the teeth of the bucket 133 from that point in the excavation direction. For example, the excavation target specification unit 1109 specifies the distribution of earth, which is the excavation target, from the three-dimensional shape shown by the three-dimensional map, and specifies the excavation point P22 based on the distribution. FIG. 5 is a view showing an example of a bucket path after dumping in the automatic excavation and loading control according to the first embodiment.

The excavation position specification unit 1110 specifies a point separated from the excavation point P22 specified by the excavation target specification unit 1109 by the distance from the base end portion of the bucket 133 to the teeth as an excavation position P19. In other words, in a case where the bucket 133 is in a predetermined excavation posture with the teeth facing the dump direction, the tip end of the arm 132 is positioned at the excavation position P19 when the teeth of the bucket 133 is positioned at the excavation point P22.

In other words, the excavation position specification unit 1110 determines the target azimuth direction of the swing body 120 in the swing control by specifying the excavation position P19. The excavation position specification unit 1110 is an example of a target azimuth direction determination unit.

In a case where the operation signal input unit 1103 receives the input of the excavation and loading instruction signal, the movement processing unit 1111 generates the rotation operation signal for moving the bucket 133 to the loading position P13 based on the loading position P13 specified by the loading position specification unit 1107 and the interference avoidance position P12 specified by the avoidance position specification unit 1108. In other words, the movement processing unit 1111 generates the rotation operation signal so as to reach the loading position P13 from the excavation completion position P10 via a swing start position P11 and the interference avoidance position P12. Further, the movement processing unit 1111 generates the rotation operation signal of the bucket 133 such that a ground angle of the bucket 133 does not change even when the boom 131 and the arm 132 are driven.

When the bucket 133 reaches the loading position P13, the movement processing unit 1111 generates the dump operation signal for rotating the bucket 133 in the dump direction. The movement processing unit 1111 generates the rotation operation signal for moving the bucket 133 to the excavation position P19 based on the excavation position P19 specified by the excavation position specification unit 1110 and the interference avoidance position P12 specified by the avoidance position specification unit 1108. In other words, the movement processing unit 1111 generates the rotation operation signal so as to reach the excavation position P19 from the loading position P13 via the interference avoidance position P12 and a swing end position P18. The movement processing unit 1111 generates the rotation operation signal of the bucket such that the bucket is in the excavation posture. The operation signal generated by the movement processing unit 1111 is a signal for instructing to drive with the driving amount related to the operation signal input to the operation signal input unit 1103 when the lever or pedal of the operating device 123 is operated with the maximum operating amount. The driving amount is, for example, the amount of hydraulic oil or the opening degree of the spool.

In a case where the loading machine 100 is driven by the remote operation, the operation signal generated by the movement processing unit 1111 may be a signal for instructing to drive with a driving amount larger than the driving amount related to the maximum operating amount. This is because the loading machine 100 related to the remote operation is not limited by the riding comfort of the operator while the loading machine 100 related to a manned operation is limited by the maximum operating amount of the operating device 123 due to the riding comfort of the operator.

The operation signal output unit 1112 outputs the operation signal input to the operation signal input unit 1103 and the operation signal generated by the movement processing unit 1111. Specifically, the operation signal output unit 1112 outputs the operation signal related to the automatic control generated by the movement processing unit 1111 in a case where the automatic excavation and loading control is being performed, and outputs the operation signal related to the manual operation of the operator which is input to the operation signal input unit 1103 in a case where the automatic excavation and loading control is not being performed.

(Automatic Excavation and Loading Control)

When the operator of the loading machine 100 determines that the loading machine 100 and the loading target 200 are in a positional relationship that allows loading processing, the operator turns on the automatic control switch of the operating device 123. Accordingly, the operating device 123 generates and outputs the excavation and loading instruction signal.

Figure 6:
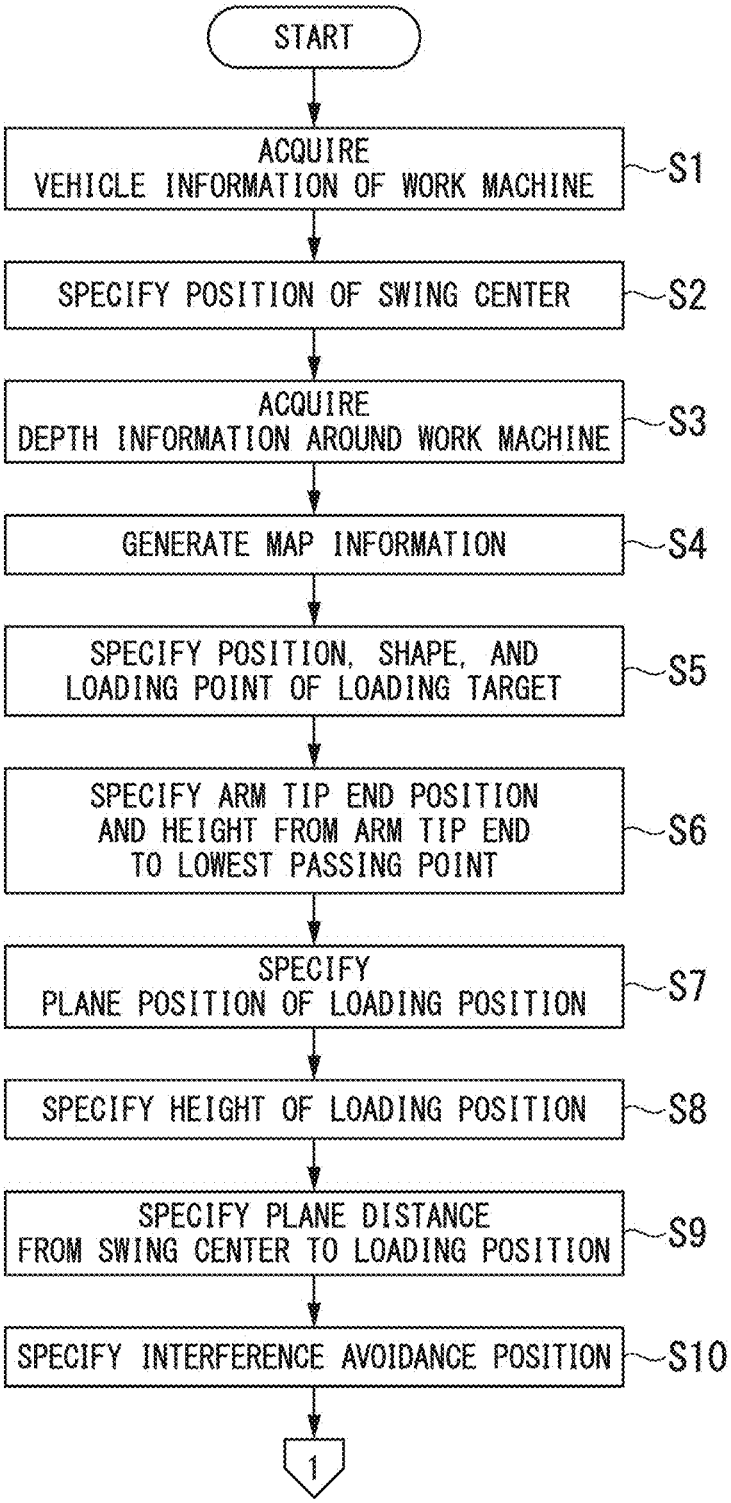
FIG. 6 is a flowchart showing the automatic excavation and loading control according to the first embodiment.
Figure 7:
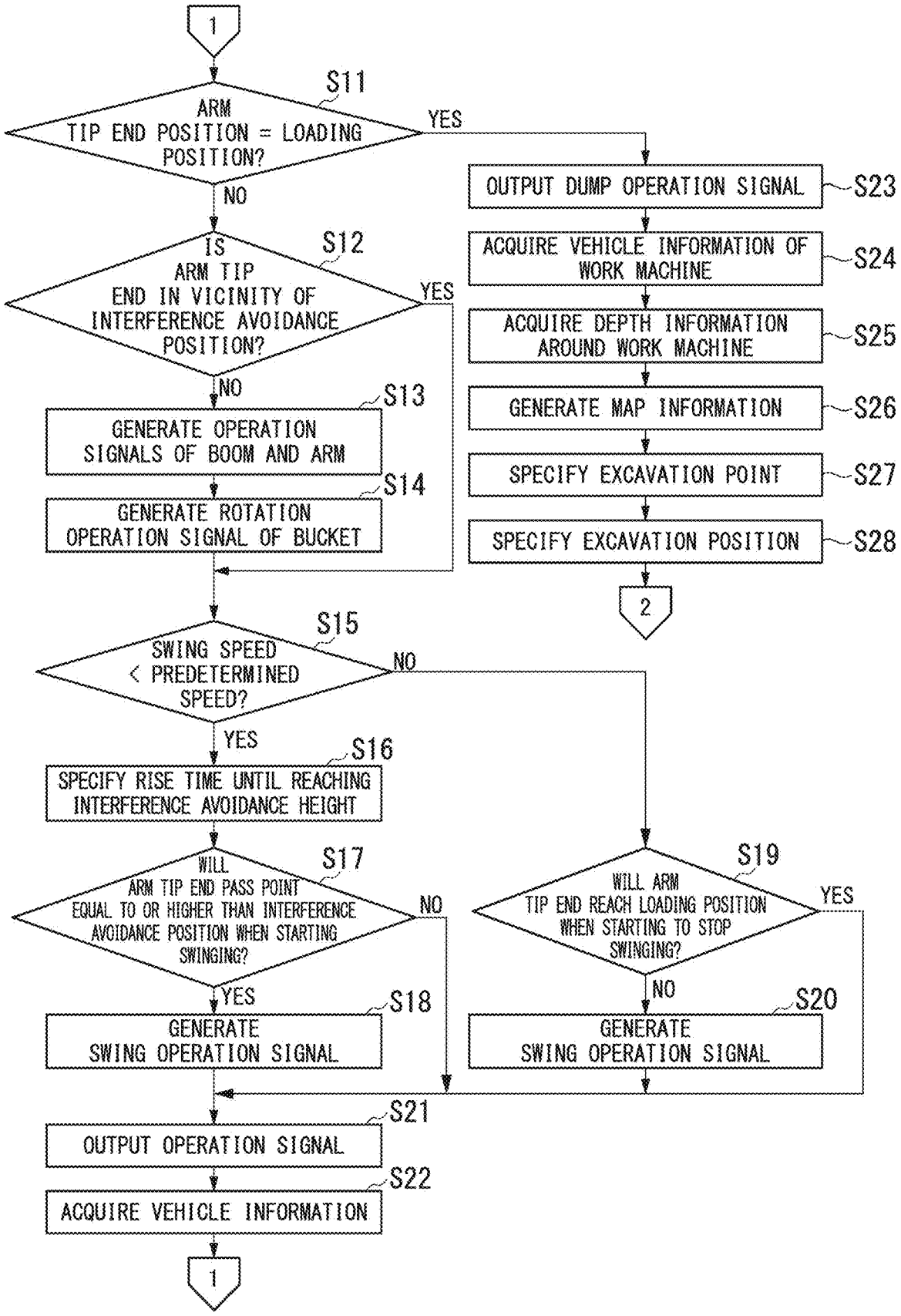
FIG. 7 is a flowchart showing the automatic excavation and loading control according to the first embodiment.
Figure 8:
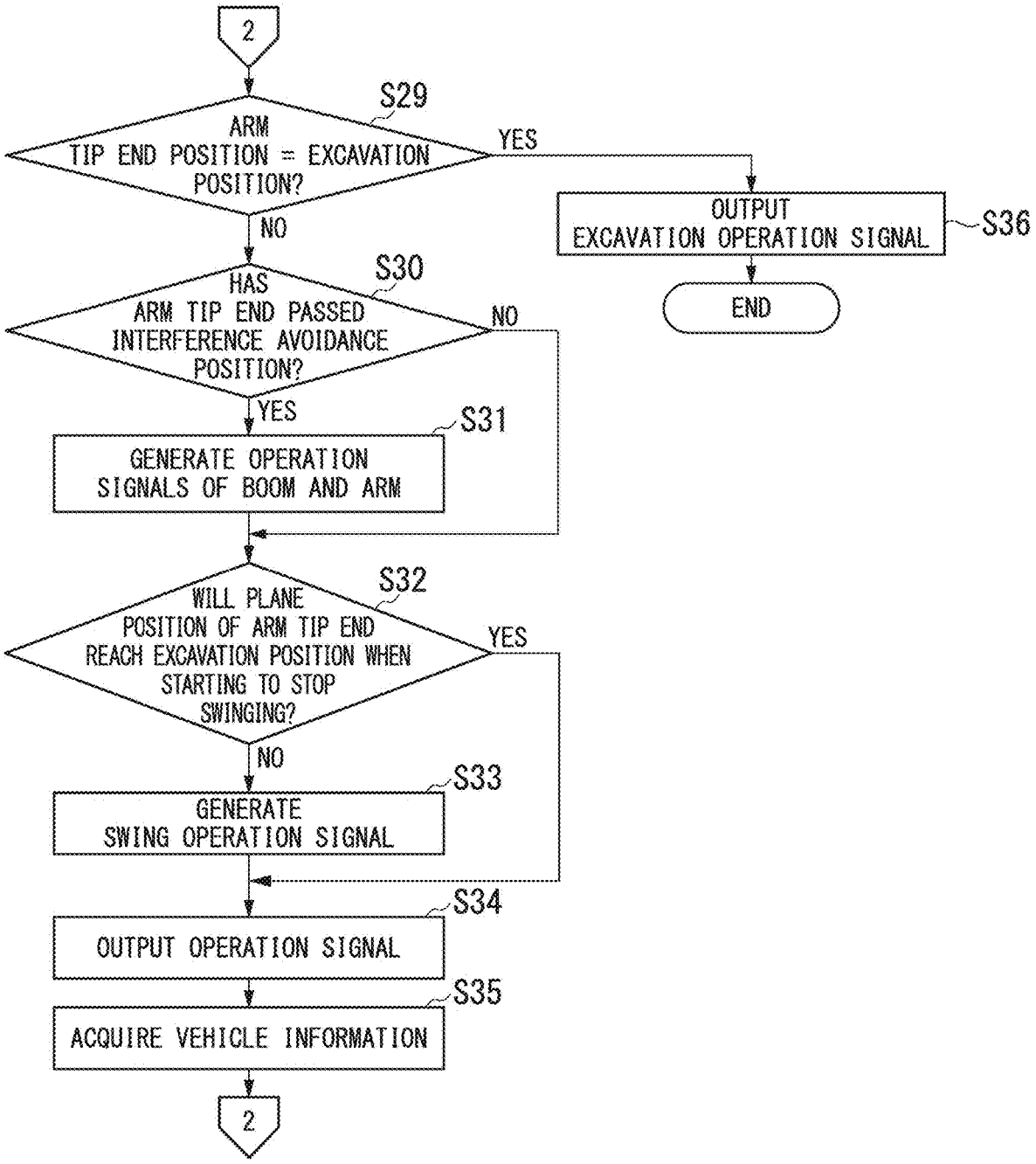
FIG. 8 is a flowchart showing the automatic excavation and loading control according to the first embodiment.

FIGS. 6 to 8 are flowcharts showing the automatic excavation and loading control according to the first embodiment. When receiving the input of the excavation and loading instruction signal from the operator, the control device 128 executes the automatic excavation and loading control shown in FIGS. 6 to 8. At the start of the automatic excavation and loading control, the teeth of the bucket 133 is positioned at the excavation point, and the loading target 200 is positioned on the side of the swing body 120.

The vehicle information acquisition unit 1101 acquires the position and azimuth direction of the swing body 120, the inclination angles of the boom 131, the arm 132, and the bucket 133, the posture of the swing body 120 (step S1). The vehicle information acquisition unit 1101 specifies the position of the swing center of the swing body 120 based on the acquired position and the azimuth direction of the swing body 120 (step S2).

The detection information acquisition unit 1102 acquires depth information indicating the depth of the surrounding of the loading machine 100 from the depth detecting device 124 (step S3). Since the depth detecting device 124 is provided on the side surface of the swing body 120 and the loading target 200 is positioned on the side of the swing body 120, the detection range R of the depth detecting device 124 includes the loading target 200. The map generation unit 1105 generates a three-dimensional map representing the shape of at least part of the surrounding of the loading machine 100 by the field coordinate system based on the position, azimuth direction, and posture of the swing body 120 acquired by the vehicle information acquisition unit 1101 and the depth information acquired by the detection information acquisition unit 1102 (step S4). The loading target specification unit 1106 specifies the position and shape of the loading target 200 and the loading point P21 based on the generated map information (step S5).

Based on the vehicle information acquired by the vehicle information acquisition unit 1101, the bucket position specification unit 1104 specifies the position P of the tip end portion of the arm 132 when the excavation and loading instruction signal is input, and the height Hb from the tip end of the arm 132 to the lowest passing point of the bucket 133 (step S6). The bucket position specification unit 1104 specifies the position P as the excavation completion position P10.

The loading position specification unit 1107 specifies the plane position of the loading position P13 based on the position of the loading point P21 specified by the loading target specification unit 1106 (step S7). At this time, the loading position specification unit 1107 specifies the height of the loading position P13 by adding the height Hb from the tip end portion of the arm 132 specified in step S5 to the lowest passing point of the bucket 133 and the height for the control margin of the bucket 133, to the height Ht of the loading target 200 (step S8).

The avoidance position specification unit 1108 specifies the plane distance from the swing center of the swing body 120 to the loading position (step S9). The avoidance position specification unit 1108 specifies the position separated from the swing center by the specified plane distance, that is, the position at which the outer shape of the bucket 133 does not interfere with the loading target 200 in a plan view and which is the closest to the loading position P13, as the interference avoidance position P12 (step S10).

The swing body 120 is not swinging between steps S1 and S9.

The movement processing unit 1111 determines whether or not the position P of the tip end portion of the arm 132 has reached the loading position P13 (step S11). In a case where the position P of the tip end portion of the arm 132 has not reached the loading position P13 (step S11: NO), the movement processing unit 1111 determines whether or not the position P of the tip end portion of the arm 132 is in the vicinity of the interference avoidance position P12 (step S12). For example, the movement processing unit 1111 determines whether or not a difference between the height of the tip end of the arm 132 and the height of the interference avoidance position P12 is less than a predetermined threshold value, or a difference between the plane distance from the swing center of the swing body 120 to the tip end of the arm 132 and the plane distance from the swing center to the interference avoidance position P12 is less than a predetermined threshold value (step S12). In a case where the position P of the tip end portion of the arm 132 is not in the vicinity of the interference avoidance position P12 (step S12: NO), the movement processing unit 1111 generates the operation signal for raising the boom 131 and the arm 132 to the height of the interference avoidance position P12 (step S13). At this time, the movement processing unit 1111 generates the operation signal based on the positions and speeds of the boom 131 and the arm 132.

In addition, the movement processing unit 1111 calculates a sum of the angular speeds of the boom 131 and the arm 132 based on the generated operation signals of the boom 131 and the arm 132, and generates the operation signal for rotating the bucket 133 at the same speed as the sum of the angular speeds (step S14). Accordingly, the movement processing unit 1111 can generate the operation signal for holding the ground angle of the bucket 133. In another embodiment, the movement processing unit 1111 may generate the operation signal for rotating the bucket 133 such that the ground angle of the bucket 133 obtained by calculating from the detected values of the boom stroke sensor 137, the arm stroke sensor 138, and the bucket stroke sensor 139 becomes equal to the ground angle when the automatic control is started.

In a case where the position P of the tip end portion of the arm 132 is in the vicinity of the interference avoidance position P12 (step S12: YES), the movement processing unit 1111 does not generate the operation signals of the boom 131, the arm 132, and the bucket 133. In other words, in a case where the position P of the tip end portion of the arm 132 is in the vicinity of the interference avoidance position P12, the movement processing unit 1111 prohibits the output of the operation signal of the work equipment 130 for moving the work equipment 130 to the loading point.

The movement processing unit 1111 determines whether or not the swing speed of the swing body 120 is lower than a predetermined speed based on the vehicle information acquired by the vehicle information acquisition unit 1101 (step S15). In other words, the movement processing unit 1111 determines whether or not the swing body 120 is swinging.

In a case where the swing speed of the swing body 120 is lower than the predetermined speed (step S15: YES), the movement processing unit 1111 specifies a rise time which is time for the height of the bucket 133 to reach the height of the interference avoidance position P12 from the height of the excavation completion position P10 (step S16). In a case where the swing operation signal is output at the current timing based on the rise time of the bucket 133, the movement processing unit 1111 determines whether or not the tip end of the arm 132 will pass the interference avoidance position P12 or a point higher than the interference avoidance position P12 (step S17). In a case where the tip end of the arm 132 will pass the interference avoidance position P12 or the point higher than the interference avoidance position P12 when the swing operation signal is output at the current timing (step S17: YES), the movement processing unit 1111 generates the swing operation signal (step S18).

In a case where the tip end of the arm 132 will pass a point lower than the interference avoidance position P12 when the swing operation signal is output at the current timing (step S17: NO), the movement processing unit 1111 does not generate the swing operation signal. In other words, in a case where the tip end of the arm 132 will pass a point lower than the interference avoidance position P12, the movement processing unit 1111 prohibits the output of the swing operation signal.

In a case where the swing speed of the swing body 120 is equal to or higher than the predetermined speed (step S15: NO), the movement processing unit 1111 determines whether or not the tip end of the arm 132 will reach the loading position P13 when the output of the swing operation signal is stopped at the current timing (step S19). After the output of the swing operation signal is stopped, the swing body 120 continues to swing due to inertia while decelerating, and then stops. In a case where the tip end of the arm 132 will reach the loading position P13 when the output of the swing operation signal is stopped at the current timing (step S19: YES), the movement processing unit 1111 does not generate the swing operation signal. In other words, in a case where the tip end of the arm 132 will reach the loading position P13 when the output of the swing operation signal is stopped at the current timing, the movement processing unit 1111 prohibits the output of the swing operation signal. Accordingly, the swing body 120 starts decelerating.

On the other hand, in a case where the tip end of the arm 132 will be stopped before reaching the loading position P13 when the output of the swing operation signal is stopped at the current timing (step S19: NO), the movement processing unit 1111 generates the swing operation signal (step S20).

When at least one of the rotation operation signals of the boom 131, the arm 132, and the bucket 133 and the swing operation signal of the swing body 120 is generated in the process from step S11 to step S20, the operation signal output unit 1112 outputs the generated operation signal to the hydraulic device 127 (step S21). Then, the vehicle information acquisition unit 1101 acquires the vehicle information (step S22). Accordingly, the vehicle information acquisition unit 1101 can acquire the vehicle information after operating by the output operation signal. The control device 128 returns the process to step S11, and repeatedly executes the generation of the operation signal.

On the other hand, in step S11, in a case where the position P of the tip end portion of the arm 132 has reached the loading position P13 (step S11: YES), the movement processing unit 1111 generates the dump operation signal, and the operation signal output unit 1112 outputs the dump operation signal to the hydraulic device 127 (step S23). Accordingly, earth accommodated in the bucket 133 is loaded to the loading target 200. When the position P of the tip end portion of the arm 132 has reached the loading position P13, the swing of the swing body 120 is stopped. The bucket 133 takes a predetermined excavation posture by rotating in the dump direction.

The vehicle information acquisition unit 1101 acquires the position and azimuth direction of the swing body 120, the inclination angles of the boom 131, the arm 132, and the bucket 133, the posture of the swing body 120 (step S24). The detection information acquisition unit 1102 acquires the depth information indicating the depth of at least part of the surrounding of the loading machine 100 from the depth detecting device 124 (step S25). Since the depth detecting device 124 is provided on the side surface of the swing body 120 and the excavation target is positioned on the side of the swing body 120, the detection range R of the depth detecting device 124 includes the excavation target. The map generation unit 1105 generates the three-dimensional map representing the shape of at least part of the surrounding of the loading machine 100 by the field coordinate system based on the position, azimuth direction, and posture of the swing body 120 acquired by the vehicle information acquisition unit 1101, and the depth information acquired by the detection information acquisition unit 1102 (step S26). The excavation target specification unit 1109 specifies the excavation point P22 based on the generated three-dimensional map (step S25). The excavation position specification unit 1110 specifies the excavation position P19 based on the position of the excavation point P22 specified by the excavation target specification unit 1109 (step S28).

The movement processing unit 1111 determines whether or not the position P of the tip end portion of the arm 132 has reached the excavation position P19 (step S29). In a case where the position P of the tip end portion of the arm 132 has not reached the excavation position P19 (step S29: NO), the movement processing unit 1111 determines whether or not the position P of the tip end portion of the arm 132 has passed the interference avoidance position P12 (step S30). In a case where the position P of the tip end portion of the arm 132 has not passed the interference avoidance position P12 (step S30: NO), the movement processing unit 1111 does not generate the operation signals of the boom 131, the arm 132, and the bucket 133. In other words, in a case where the position P of the tip end portion of the arm 132 has not passed the interference avoidance position P12, the movement processing unit 1111 prohibits the output of the operation signal of the work equipment 130 for moving the work equipment 130 to the excavation point.

On the other hand, in a case where the position P of the tip end portion of the arm 132 has passed the interference avoidance position P12 (step S30: YES), the movement processing unit 1111 generates the operation signal of the boom 131 and the arm 132 for lowering the position P of the tip end portion of the arm 132 (step S31).

Next, in a case where the output of the swing operation signal is stopped at the current timing, the movement processing unit 1111 determines whether or not the plane position of the tip end of the arm 132 will reach the excavation position P19 (step S32). In a case where the plane position of the tip end of the arm 132 will not reach the excavation position P19 when the output of the swing operation signal is stopped at the current timing (step S32: NO), the movement processing unit 1111 generates the swing operation signal (step S33).

On the other hand, in a case where the plane position of the tip end of the arm 132 will reach the excavation position P19 when the output of the swing operation signal is stopped at the current timing (step S32: YES), the movement processing unit 1111 does not generate the swing operation signal. In other words, in a case where the plane position of the tip end of the arm 132 will reach the excavation position P19 when the output of the swing operation signal is stopped at the current timing, the movement processing unit 1111 prohibits the output of the swing operation signal. Accordingly, the swing body 120 starts decelerating.

When at least one of the operation signals of the boom 131 and the arm 132, and the swing operation signal of the swing body 120 is generated in the process from step S30 to step S33, the operation signal output unit 1112 outputs the generated operation signal to the hydraulic device 127 (step S34).

Then, the vehicle information acquisition unit 1101 acquires the vehicle information (step S35). Accordingly, the vehicle information acquisition unit 1101 can acquire the vehicle information after operating by the output operation signal. The control device 128 returns the process to step S29 and repeatedly executes the generation of the operation signal.

On the other hand, in step S29, in a case where the position P of the tip end portion of the arm 132 has reached the excavation position P19 (step S29: YES), the movement processing unit 1111 generates the excavation operation signal, and the operation signal output unit 1112 outputs the excavation operation signal to the hydraulic device 127 (step S36). Accordingly, the teeth of the bucket 133 moves to the excavation completion position P10, and earth is accommodated in the bucket 133. Then, the control device 128 ends the automatic excavation and loading control. Otherwise, the control device 128 returns the process to step S11 and repeatedly executes automatic loading and automatic excavation within a range in which the loading capacity of the loading target 200 does not exceed the maximum loading capacity.

By the above-described automatic excavation and loading control, the loading machine 100 can load earth scooped by the bucket 133 into the loading target 200, and further scoop the next earth. The operator repeatedly executes the automatic excavation and loading control by the input of the excavation and loading instruction signal to the extent that the loading capacity of the loading target 200 does not exceed the maximum loading capacity.

(Action and Effect)

As described above, the control device 128 of the loading machine 100 according to the first embodiment determines the target azimuth direction based on the posture information and the depth information acquired when the swing body 120 is not swinging. By acquiring the posture information and depth information when the swing body 120 is not swinging, it is possible to suppress the error of the posture information when the depth information is acquired to be small. Therefore, the control device 128 according to the first embodiment can accurately determine the target azimuth direction in the swing control. The target azimuth direction according to the first embodiment is an azimuth direction in which the loading position P13 faces, which is the target azimuth direction in the loading swing, and an azimuth direction in which the excavation position P19 faces, which is the target azimuth direction in the empty swing. The control device 128 according to another embodiment may determine either the target azimuth direction in the loading swing or the target azimuth direction in the empty swing. In this case, the depth detecting device 124 may be provided on only one of both side portions of the swing body 120.

The work equipment 130 according to the first embodiment is provided at the front portion of the swing body 120, and the depth detecting device 124 is provided at the side portion of the swing body 120. Accordingly, the depth detecting device 124 can measure the depth of the excavation target when the work equipment 130 is performing the loading work on the loading target 200. In addition, accordingly, the depth detecting device 124 can measure the depth of the loading target 200 when the work equipment 130 is performing the excavation work on the excavation target. The depth detecting device 124 according to the first embodiment is installed such that the work equipment 130 is not included in the detection range R. Accordingly, the control device 128 can specify the loading point P21 and the excavation point P22 without performing a process of excluding the range including the work equipment 130 from the depth information.

Above, the embodiment has been described in detail with reference to the drawings, but the specific configuration is not limited to the above-described configuration, and various design changes can be made.

For example, the control device 128 according to the first embodiment specifies the loading point P21 and the excavation point P22 by using the depth information, but the invention is not limited thereto. The control device 128 according to the other embodiment may specify only one of the loading point P21 and the excavation point P22 by using the depth information. In other words, the control device 128 according to the first embodiment performs the automatic excavation and loading control, but the invention is not limited thereto. The control device 128 according to another embodiment performs the automatic loading control, and the excavation work may be performed by the manual operation of the operator. Further, the control device 128 according to another embodiment performs the automatic excavation control, and the loading work may be performed by the manual operation of the operator.

Further, the control device 128 according to the first embodiment specifies the excavation point P22 and executes the excavation operation after the swing operation to the excavation point P22. However, it is not limited thereto, and the automatic excavation and loading control may be ended by executing the process up to the swing operation to the excavation point P22.

Further, the control device 128 according to the first embodiment specifies the loading point P21 by using the posture information and depth information acquired after the excavation operation and before the loading swing, but the invention is not limited thereto. For example, the control device 128 according to another embodiment may specify the loading point P21 by using the posture information and depth information acquired after the empty swing and before the excavation operation, or the posture information and depth information acquired during the excavation operation. In either case, the posture information and depth information are acquired when the swing body 120 is not swinging or is slightly swinging even when the swing body 120 is swinging.

Further, the control device 128 according to the first embodiment specifies the excavation point P22 by using the posture information and depth information acquired after the dump operation and before the empty swing, but the invention is not limited thereto. For example, the control device 128 according to another embodiment may specify the excavation point P22 by using the posture information and depth information acquired after the loading swing and before the dump operation or after the loading swing and during the dump operation. In either case, the posture information and depth information are acquired when the swing body 120 is not swinging or is slightly swinging even when the swing body 120 is swinging.

Further, the detection range R of the depth detecting device 124 according to the first embodiment considers an axis extending in the width direction of the swing body 120 as a center, but the invention is not limited thereto. For example, the depth detecting device 124 may be provided such that the angle formed by the front direction of the swing body 120 and the center axis of the detection range R substantially coincides with the average swing angle or the target swing angle in the excavation and loading cycle.

In addition, although the loading machine 100 according to the first embodiment includes the bucket 133, but the invention is not limited thereto. For example, the loading machine 100 according to another embodiment may include a clam bucket that can open and close the backhoe and the clam shell.

Although the loading machine 100 according to the first embodiment is a manned driving vehicle which an operator boards and operates, but the invention is not limited thereto. For example, the loading machine 100 according to another embodiment is a remotely operated vehicle that is operated by an operation signal acquired by communication from a remote operating device that is operated by an operator in a remote office while looking at a monitor screen. In this case, some functions of the control device 128 may be provided in the remote operating device.

The control device according to the present invention can accurately determine the target azimuth direction in the swing control.

What is claimed is:

1. A control device for controlling a loading machine including a swing body swingable around a swing center by hydraulic oil supplied from a hydraulic pump included in a hydraulic device, work equipment provided on the swing body, a posture measuring device configured to measure a posture of the swing body, and a depth detecting sensor that is provided in the swing body and configured to detect a depth of at least part of a surrounding of the swing body in a detection range, the posture measuring device including receivers configured to receive positioning signals and an inertial measurement sensor configured to measure an acceleration and an angular speed of the swing body, the control device comprising:

a memory in which a program is loaded; and a processor configured to execute the program, the processor including, by executing the program, a posture information acquisition unit configured to acquire posture information indicating the posture measured by the posture measuring device;

a detection information acquisition unit configured to acquire depth information indicating the depth detected by the depth detecting sensor;

a target azimuth direction determination unit configured to determine a target azimuth direction in swing control based on the posture information and the depth information acquired when the swing body is stopped swinging; and an output unit configured to output, to the hydraulic device, a swing operation signal for swinging the swing body based on the target azimuth direction, the target azimuth direction determination unit being configured to determine an azimuth direction toward a loading target as the target azimuth direction based on the posture information and the depth information acquired while the work equipment performs excavation work on an excavation target.

2. The control device according to claim 1, wherein the processor further includes, by executing the program, a map generation unit configured to generate a three-dimensional map indicating a three-dimensional position of at least part of the surrounding of the swing body based on the posture information and the depth information acquired when the swing body is not swinging, the target azimuth direction determination unit being configured to determine the target azimuth direction based on the three-dimensional map.

3. The control device according to claim 1, wherein the work equipment is provided at a front portion of the swing body, and the depth detecting sensor is provided at a side portion of the swing body.

4. A loading machine including the control device the control device of claim 1, the loading machine further comprising:

the swing body swingable around the swing center;

the work equipment provided on the swing body;

a posture measuring device configured to measure a posture of the swing body;

the depth detecting sensor provided in the swing body and configured to detect the depth of at least part of the surrounding of the swing body in the detection range.

5. A control method of a loading machine including a swing body swingable around a swing center by hydraulic oil supplied from a hydraulic pump included in a hydraulic device, work equipment provided on the swing body, a posture measuring device configured to measure a posture of the swing body, and a depth detecting sensor that is provided in the swing body and configured to detect a depth of a surrounding of the swing body in a detection range, the posture measuring device including receivers configured to receive positioning signals and an inertial measurement sensor configured to measure an acceleration and an angular speed of the swing body, the control method comprising:

acquiring posture information indicating the posture measured by the posture measuring device;

acquiring depth information indicating the depth detected by the depth detecting sensor;

determining a target azimuth direction in swing control based on the posture information and the depth information acquired when the swing body is not swinging; and outputting, to the hydraulic device, a swing operation signal for swinging the swing body based on the target azimuth direction, the determining the target azimuth direction including determining an azimuth direction toward a loading target as the target azimuth direction based on the posture information and the depth information acquired while the work equipment performs excavation work on an excavation target.

* * * * *